US010654088B2

(12) United States Patent
Grant

(10) Patent No.: US 10,654,088 B2
(45) Date of Patent: May 19, 2020

(54) EAVESTROUGH OUTLET CUTTER

(71) Applicant: Kevin Anthony Grant, Winnipeg (CA)

(72) Inventor: Kevin Anthony Grant, Winnipeg (CA)

( * ) Notice: Subject to any disclaimer, the term of this patent is extended or adjusted under 35 U.S.C. 154(b) by 406 days.

(21) Appl. No.: 15/599,562

(22) Filed: May 19, 2017

(65) Prior Publication Data

US 2017/0368591 A1 Dec. 28, 2017

Related U.S. Application Data

(60) Provisional application No. 62/354,977, filed on Jun. 27, 2016.

(51) Int. Cl.

| | |
|---|---|
| ***B21D 28/00*** | (2006.01) |
| ***B21D 28/32*** | (2006.01) |
| ***B21D 28/26*** | (2006.01) |
| ***B21D 43/00*** | (2006.01) |
| ***B21D 45/00*** | (2006.01) |

(52) U.S. Cl.

CPC ..... *B21D 28/32* (2013.01); *B21D 28/26* (2013.01); *B21D 43/00* (2013.01); *B21D 45/00* (2013.01); *B21D 28/00* (2013.01)

(58) Field of Classification Search

CPC ..... B21D 31/02; B21D 28/00; B21D 28/26; B21D 28/24; B21D 28/243; B21D 28/32; B21D 28/34; B23D 25/02; B23D 25/04

USPC ..... 83/343–345; 72/324, 332, 333

See application file for complete search history.

(56) References Cited

U.S. PATENT DOCUMENTS

| | | | | | |
|---|---|---|---|---|---|
| 2,214,584 | A | * | 9/1940 | Heydenburg | B23D 27/00 83/574 |
| 3,411,527 | A | * | 11/1968 | Nielsen, Jr. | B21D 28/28 137/318 |
| 3,589,159 | A | * | 6/1971 | Warstler | B21D 5/08 72/131 |
| 3,821,890 | A | * | 7/1974 | Dewey | B21C 37/292 72/325 |
| 3,910,093 | A | * | 10/1975 | Maloney, Jr. | B21D 28/10 72/325 |
| 3,967,452 | A | * | 7/1976 | Maloney, Jr. | B21D 28/10 405/120 |
| 3,994,055 | A | * | 11/1976 | Maloney, Jr. | B21D 28/10 29/890.14 |
| 4,711,012 | A | * | 12/1987 | Wolters | B21D 28/34 29/243.518 |

(Continued)

*Primary Examiner* — Adam J Eiseman
*Assistant Examiner* — Bobby Yeonjin Kim
(74) *Attorney, Agent, or Firm* — Ryan W. Dupuis; Ade + Company Inc.; Kyle R. Satterthwaite

(57) ABSTRACT

An outlet cutter for cutting an outlet opening in an eavestrough has a frame including a trough opening therein arranged to receive the eavestrough therethrough. A female die including a die opening is supported on the frame directly below the trough opening so as to be arranged to be located directly below an eavestrough received through the trough opening. A male die is supported on the frame so as to be movable relative to a female die between a disengaged position spaced above the female die and a punching position fully received within the die opening in the female die using a screw. The frame is self-supported on the eavestrough for sliding. The male die has four corner portions, each formed by two side cutting edges which are sloped downwardly and outwardly towards a respective apex, with two opposed apexes protruding beyond a remainder of the die.

15 Claims, 5 Drawing Sheets

(56) References Cited

U.S. PATENT DOCUMENTS

| | | | | |
|---|---|---|---|---|
| 5,974,932 | A * | 11/1999 | Suzuki | B23D 25/04 83/318 |
| 6,289,709 | B1 * | 9/2001 | Geurts | B21D 28/002 72/325 |
| 6,439,020 | B1 * | 8/2002 | Baschnagel, III | B21D 5/08 72/181 |
| 10,137,489 | B2 * | 11/2018 | Hill | B21D 28/36 |
| 2003/0041711 | A1 * | 3/2003 | McKee | B23D 47/02 83/13 |
| 2015/0183017 | A1 * | 7/2015 | Kim | B21D 35/001 72/130 |

* cited by examiner

EAVESTROUGH OUTLET CUTTER

This application claims the benefit under 35 U.S.C. 119(e) of U.S. provisional application Ser. No. 62/354,977, filed Jun. 27, 2016.

FIELD OF THE INVENTION

The present invention relates to a cutter for cutting an outlet opening in the bottom flange of an eavestrough having front and rear walls extending upwardly from opposing edges of the bottom flange, and more particularly the present invention relates to an outer cutter for an eavestrough including a frame which supports a female die with a die opening below the bottom flange of the eavestrough and which supports a male die for movement in and out of the die opening in the female die for punching the outlet opening in the bottom flange of the eavestrough.

BACKGROUND

A common arrangement for managing precipitation about a building is to provide an eavestrough extending along various edges of the roof of the building. A typical eavestrough includes a bottom flange, a rear wall extending upward from a rear edge of the bottom flange, and a front wall extending upward from a front edge of the bottom flange. The eavestrough collects precipitation at the edge of the roof and redirects the precipitation to a downspout which typically directs the precipitation away from the building. The downspout is typically connected to the eavestrough by communication through an outlet opening formed in the bottom flange of the eavestrough.

A common method of forming outlet openings in the bottom flange of an eavestrough is to provide a suitable punch tool having a male die driven towards a die opening in a female die to punch the outlet opening in the bottom flange received between the male and female dies. Examples of a typical eavestrough outlet punches are shown in U.S. Pat. No. 6,289,709 by Geurts, U.S. Pat. No. 3,821,890 by Dewey, and U.S. Pat. No. 4,711,012 by Wolters. In each instance, a male die is driven towards the die opening in a female die along a vertical punching axis. A main frame supports the male die relative to the female die offset to only one side of the punching axis such that the portions of the frame that support each of the male and female dies are effectively cantilevered relative to a main portion of the frame. Considerable force is required to drive the male die into the die opening of the female die to punch the opening in the bottom flange of the eavestrough, resulting in bending of the frame supporting the dies which can cause misalignment of the dies relative to one another resulting in a poorly formed edge about the opening. Furthermore, known punch designs are typically quite large, cumbersome and heavy, in part to counterbalance the offset cantilevered support of the dies on the frame, such that the resulting tool is difficult to support in proper alignment relative to an eavestrough by a single operator unless the die is supported on a suitable supporting surface which is undesirable in many environments.

SUMMARY OF THE INVENTION

According to one aspect of the invention there is provided an outlet cutter for cutting an outlet opening in an eavestrough having a bottom flange, a rear wall extending upwardly from a rear edge of the bottom flange and a front wall extending upwardly from a front edge of the bottom flange, the outlet cutter comprising:

a frame including a trough opening therein arranged to receive the eavestrough therethrough;

a female die including a die opening therein supported on the frame directly below the trough opening so as to be arranged to be located directly below an eavestrough received through the trough opening; and a male die supported on the frame so as to be movable relative to a female die between a disengaged position spaced above the female die and a punching position fully received within the die opening in the female die;

the frame including a sliding support arranged to be engaged upon the eavestrough so as to support the frame slidably along the eavestrough with the female die directly below the bottom flange and the male die spaced above the bottom flange.

By providing a frame which is self-supporting for sliding along a trough, a single operator can readily position and align the dies with a desired outlet location for ease of aligning the outlet opening relative to the trough by a single operator.

The sliding support of the frame may comprise two sliding support channels supported on the frame parallel and spaced apart from one another so as to be arranged to be engaged upon respective top edges of the front wall and rear wall of the eavestrough when the female die is directly below the bottom flange of the eavestrough.

The frame may include two side frame portions, each locating a respective trough opening therein, in which the female die is supported between the two side frame portions so as to be located directly below the bottom flange of an eavestrough received through both trough openings of the two side frame portions respectively.

When provided in combination with a trough bender comprising a plurality of rollers arranged to roll form an eavestrough and a trough exit from which the formed eavestrough is dispensed, preferably the outlet cutter further comprises a storage mount arranged to selectively support the frame of the outlet cutter thereon in which the storage mount is supported on the trough bender such that the trough opening in the frame is aligned with the trough exit so that the formed eavestrough dispensed from the trough bender passes through trough opening when the outlet cutter is supported on the storage mount.

The storage mount may comprise two rails. In this instance, the outlet cutter includes two lower support channels receiving the two rails therein when the outlet cutter is supported on the storage mount, the two lower support channels supporting the outlet cutter for longitudinal sliding along the two rails in a longitudinal direction of the eavestrough. Each rail preferably includes a free end which is tapered for ease of sliding the outlet cutter onto and off of the rails in the longitudinal direction of the eavestrough.

A threaded shaft may couple the male die to the frame such that rotation of the threaded shaft drives the male die between the disengaged position and the punching position. The threaded shaft may include a quick connection supported thereon for sliding connection to a screw driver bit of a power drill. Preferably the quick connection comprises a socket having a hexagonal cross section.

The frame may further comprise a cross frame portion supporting the male die for sliding movement thereon along a vertical axis relative to the female die and a pair of side frame portions connected between the cross frame portion and the female die at two diametrically opposing sides of the vertical axis. Preferably the male die is supported for vertical sliding on the cross frame portion at two diametrically opposing sides of the vertical axis. In this instance, the outlet cutter may further comprise i) a threaded shaft coupling the male die to the cross frame portion at said vertical axis such that rotation of the threaded shaft drives the male die between the disengaged position and the punching position, and ii) a pair of sliding supports providing sliding support between the male die and the cross frame portion at said diametrically opposing sides of the vertical axis.

The outlet cutter may also include a female auxiliary die and a male auxiliary die in which the frame supports the female die and the male die thereon such that the female auxiliary die and the male auxiliary die are readily interchangeable with the female die and the male die respectively.

When the male die is generally rectangular in shape so as to comprise four corner portions, each corner portion may be comprised of a pair of side cutting edges which are sloped downwardly and outwardly towards a respective apex at a respective corner of the generally rectangular shape of the male die. Furthermore, two diagonally opposed ones of the corner portions may comprise two side cutting edges which are sloped downwardly and outwardly towards respective apexes which define primary cutting tips which protrude towards the female die beyond a remainder of the male die.

According to a second aspect of the present invention there is provided an outlet cutter for cutting an outlet opening in an eavestrough having a bottom flange, a rear wall extending upwardly from a rear edge of the bottom flange and a front wall extending upwardly from a front edge of the bottom flange, the outlet cutter comprising:

a frame including a trough opening therein arranged to receive the eavestrough therethrough;

a female die including a die opening therein supported on the frame directly below the trough opening so as to be arranged to be located directly below an eavestrough received through the trough opening;

a male die supported on the frame so as to be movable relative to a female die between a disengaged position spaced above the female die and a punching position fully received within the die opening in the female die; and a threaded shaft coupling the male die to the frame such that rotation of the threaded shaft drives the male die between the disengaged position and the punching position.

Use of a threaded shaft for driving the male die relative to the female die permits the mechanism to be readily adapted for use together with a conventional power drill which is commonly available in the construction industry. The overall size and complexity of the driving linkage can thus be greatly simplified compared to many prior art arrangements while still being easy to use with a minimum effort by a single operator.

According to a third aspect of the present invention there is provided an outlet cutter for cutting an outlet opening in an eavestrough having a bottom flange, a rear wall extending upwardly from a rear edge of the bottom flange and a front wall extending upwardly from a front edge of the bottom flange, the outlet cutter comprising:

a frame including a trough opening therein arranged to receive the eavestrough therethrough;

a female die including a die opening therein supported on the frame directly below the trough opening so as to be arranged to be located directly below an eavestrough received through the trough opening; and a male die supported on the frame so as to be movable relative to a female die between a disengaged position spaced above the female die and a punching position fully received within the die opening in the female die;

wherein the frame comprises a cross frame portion supporting the male die for sliding movement thereon along a vertical axis relative to the female die and a pair of side frame portions connected between the cross frame portion and the female die at two diametrically opposing sides of the vertical axis.

By providing a balanced frame of two side frame portions at opposing sides of the vertical punching axis, the cantilevered supporting arrangement of the dies according to various prior art punching tools can be avoided so that a much simpler and lighter frame structure can be used to provide adequate support to the dies while maintaining a much better alignment of the dies relative to one another than can be achieved with a cantilevered supporting arrangement.

According to a further aspect of the present invention there is provided an outlet cutter for cutting an outlet opening in an eavestrough having a bottom flange, a rear wall extending upwardly from a rear edge of the bottom flange and a front wall extending upwardly from a front edge of the bottom flange, the outlet cutter comprising:

a frame including a trough opening therein arranged to receive the eavestrough therethrough;

a female die including a die opening therein supported on the frame directly below the trough opening so as to be arranged to be located directly below an eavestrough received through the trough opening; and a male die supported on the frame so as to be movable relative to a female die between a disengaged position spaced above the female die and a punching position fully received within the die opening in the female die;

wherein the male die is generally rectangular in shape so as to comprise four corner portions, each comprised of a pair of side cutting edges which are sloped downwardly and outwardly towards a respective apex at a respective corner of the generally rectangular shape of the male die.

By shaping the male die to have four corner portions which are each sloped downwardly at two side edges towards a respective apex, the rectangular shaped opening is cut by first piercing the sheet-metal of the bottom flange at the four corners, followed by continued cutting towards a central intermediate location along each of the sides of the rectangular shape. This arrangement provides a much cleaner finished cutting edge about the periphery of the outlet opening, with less curling of the sheet-metal at the edges of the opening than when the punching arrangement begins at the sides of the rectangular shape and finishes at the apexes of the rectangular shape.

According to yet another aspect of the present invention there is provided an outlet cutter for cutting an outlet opening in an eavestrough having a bottom flange, a rear wall extending upwardly from a rear edge of the bottom flange and a front wall extending upwardly from a front edge of the bottom flange, the outlet cutter comprising:

a frame including a trough opening therein arranged to receive the eavestrough therethrough;

a female die including a die opening therein supported on the frame directly below the trough opening so as to be arranged to be located directly below an eavestrough received through the trough opening; and a male die supported on the frame so as to be movable relative to a female die between a disengaged position spaced above the female die and a punching position fully received within the die opening in the female die;

wherein the male die is generally rectangular in shape so as to comprise four corner portions at respective corners of the generally rectangular shape of the male die, two diagonally opposed ones of the corner portions comprising two side cutting edges which are sloped downwardly and outwardly towards respective apexes which define primary cutting tips which protrude towards the female die beyond a remainder of the male die.

Initially engaging the material to be punched at two diagonally opposed corners of a rectangular opening provides both a clean cut edge at the corners of the opening while also providing a balanced support about the central vertical punching axis, while gradually easing the male die into the die opening of the female die during punching.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
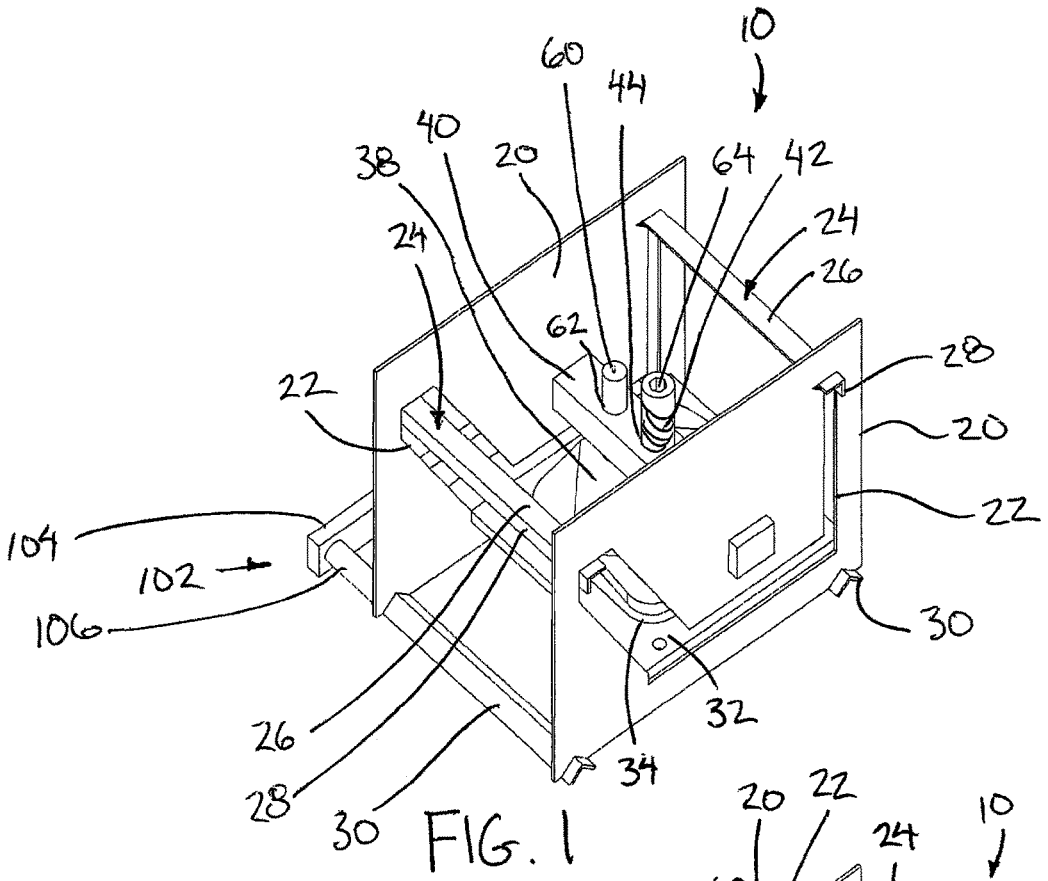
FIG. 1 is a perspective view of the outlet cutter.
Figure 2:
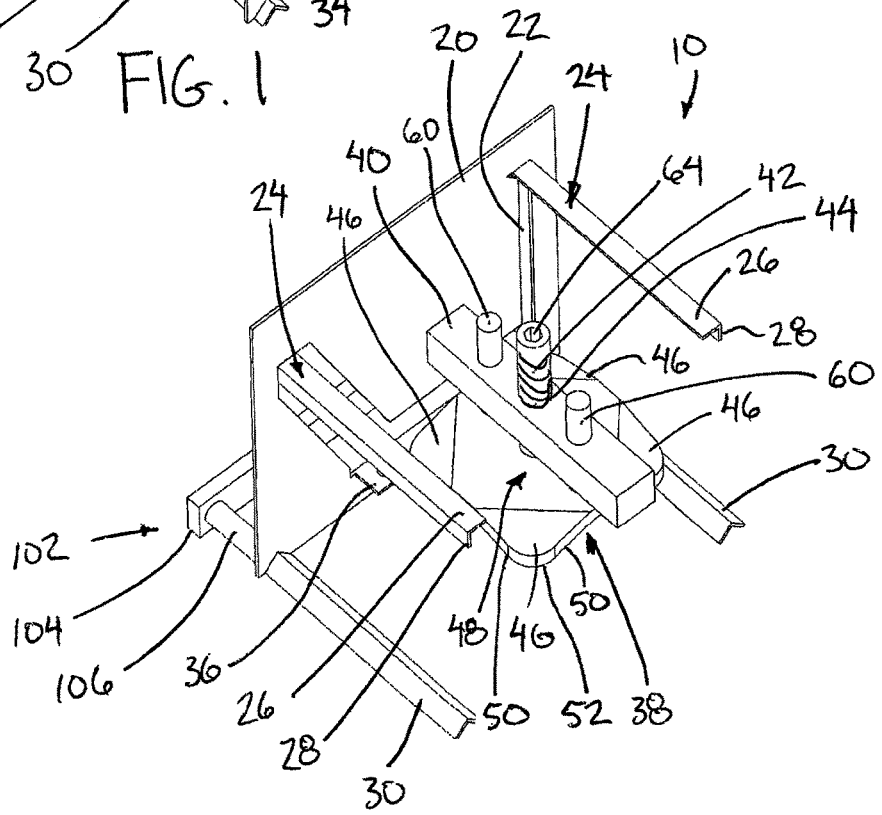
FIG. 2 is a perspective view of the outlet cutter in which one of the side frame portions is removed for clarity.
Figure 4:
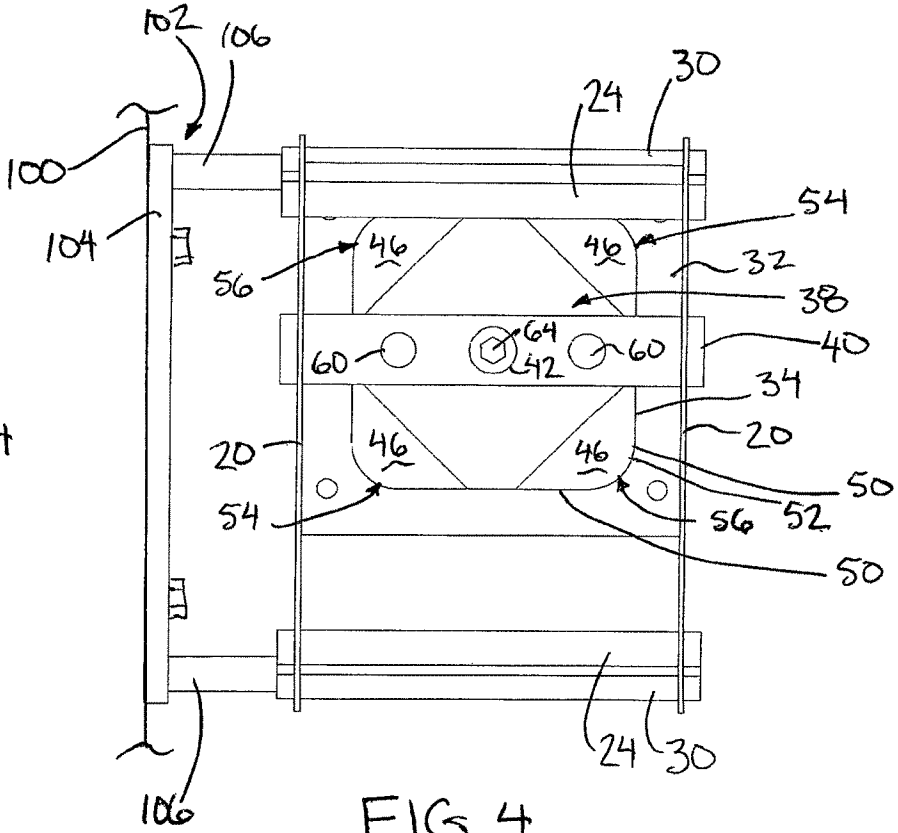
FIG. 4 is a top plan view of the outlet cutter partially supported on the storage mount at the outlet end of the trough bender.
Figure 3:
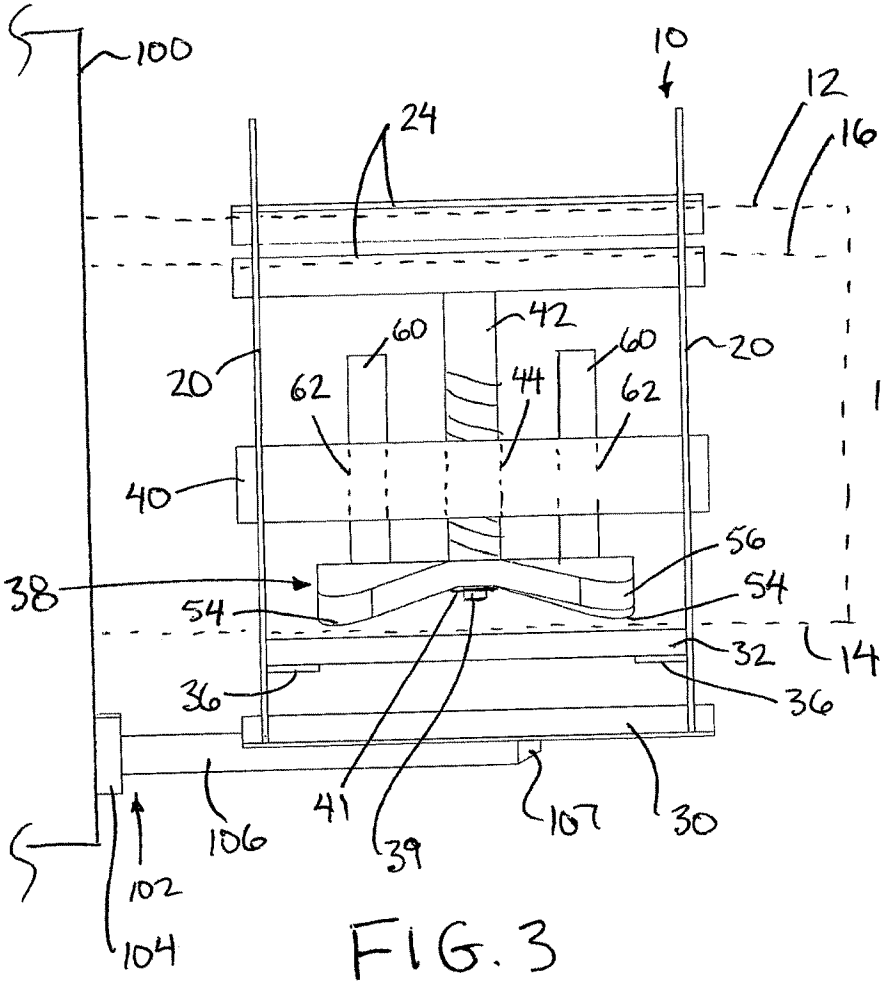
FIG. 3 is a front elevational view of the outlet cutter supported partially on the storage mount at the outlet end of a trough bender, with an eavestrough exiting the trough bender shown in broken line passing fully through the trough openings in the outlet cutter.
Figure 5:
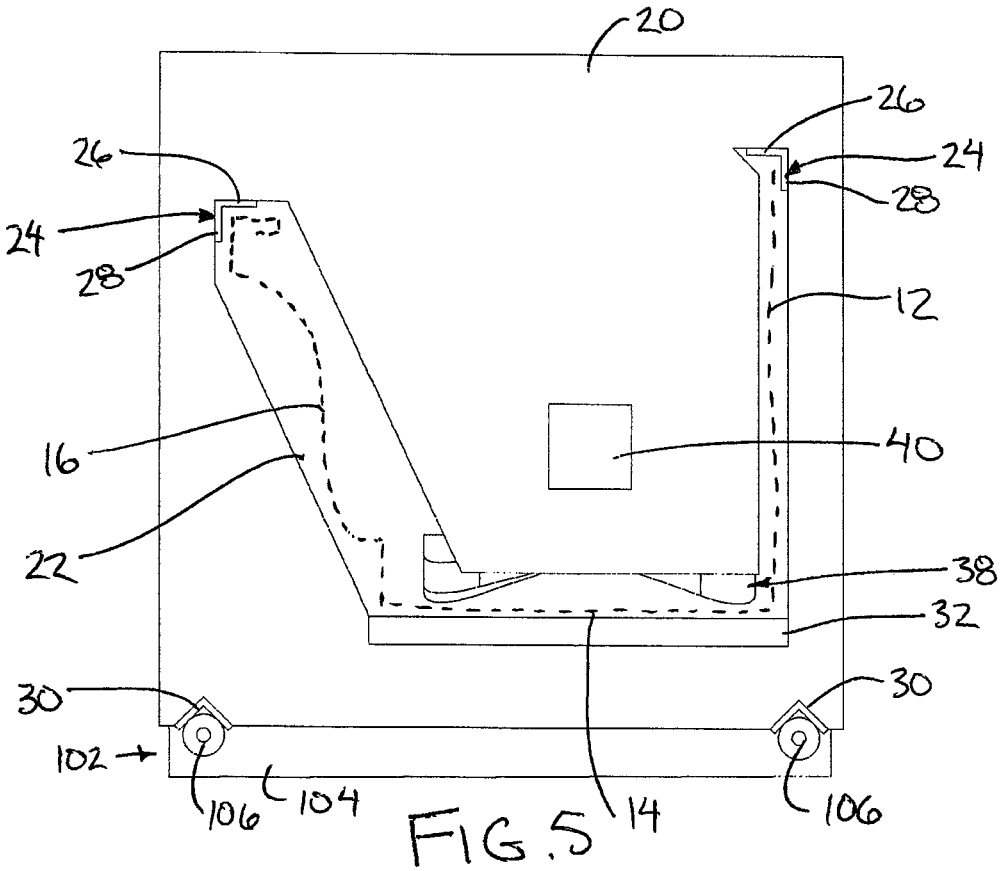
FIG. 5 is an end elevational view of the outlet cutter, with an eavestrough shown in broken line passing fully through the trough openings in the outlet cutter.
Figure 6:
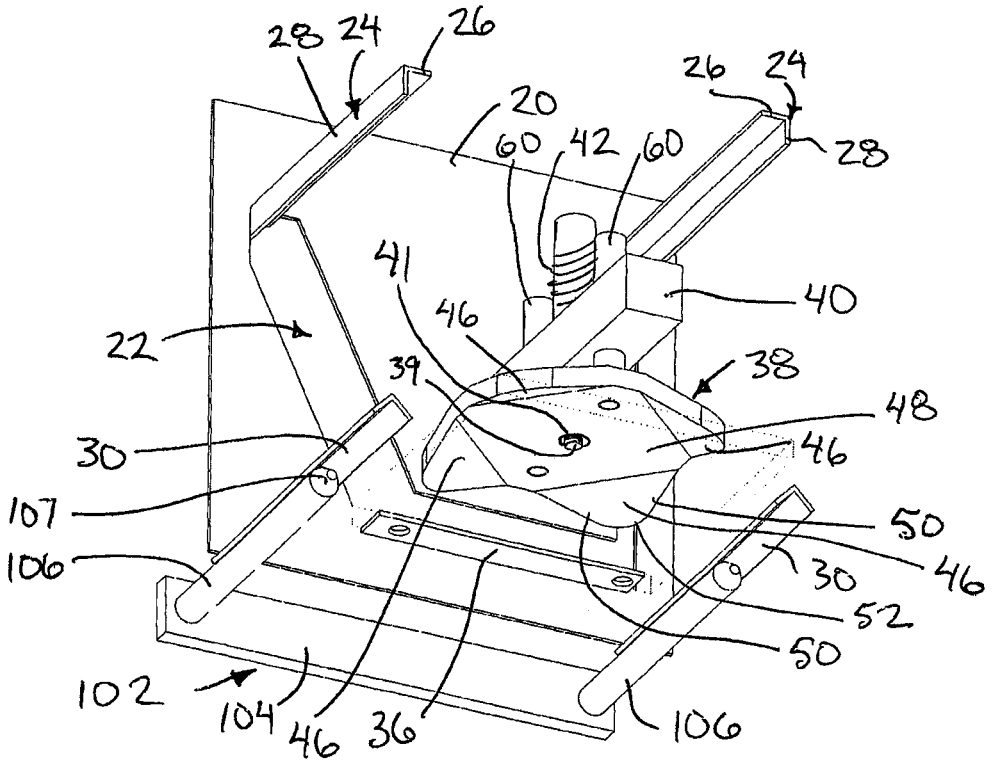
FIG. 6 is a perspective view of the outlet cutter with the female die and one side frame portion shown removed such that the bottom side of the male die is visible.
Figure 7:
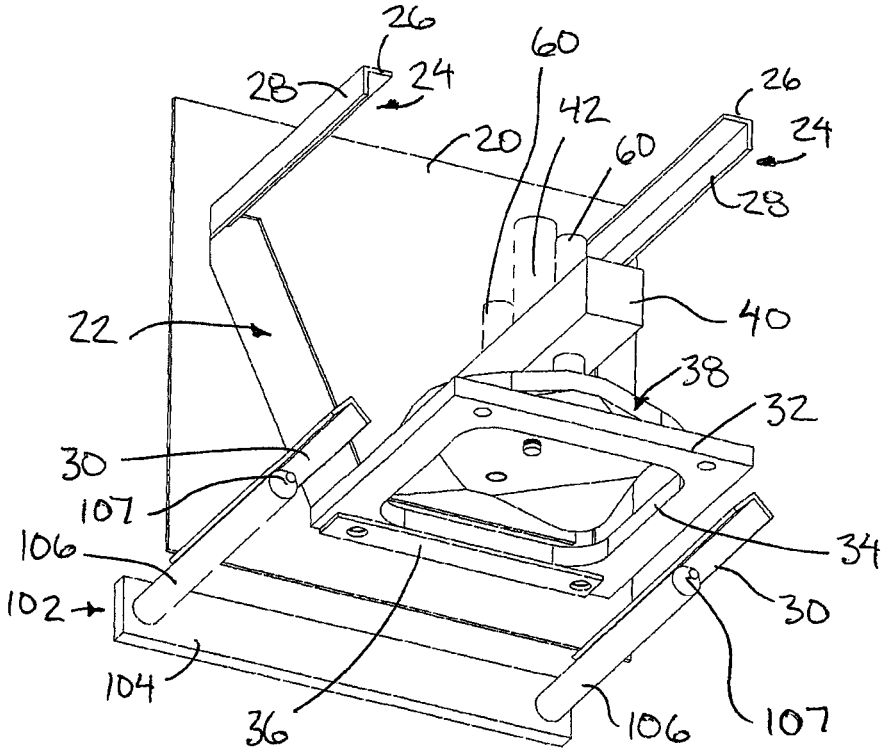
FIG. 7 is a perspective view of the outlet cutter with one side frame portion shown removed such that the bottom side of the male die is visible relative to the female die.
Figure 8:
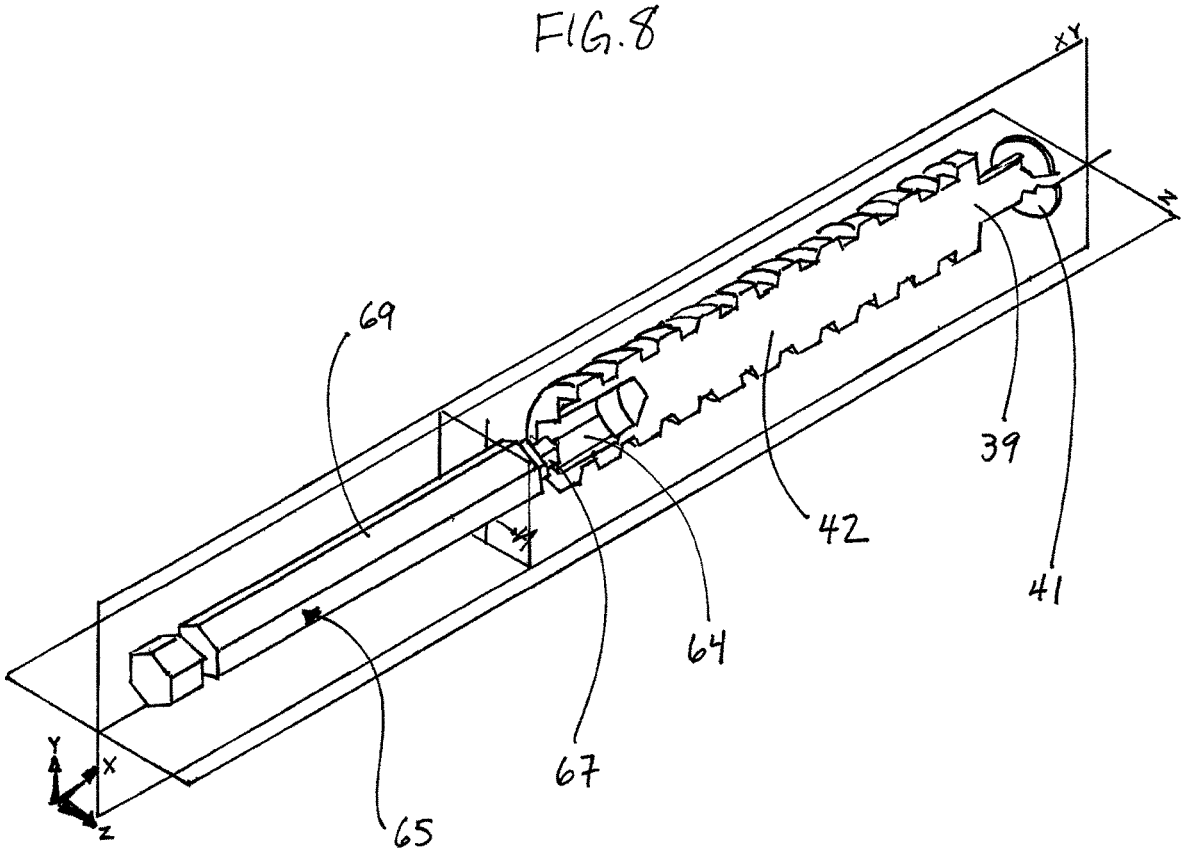
FIG. 8 is a perspective view of a screw driver bit adapted for sliding connection into the socket of the threaded shaft of the outlet cutter.

Referring to the accompanying figures, there is illustrated an eavestrough outlet cutter generally indicated by reference numeral 10. The cutter 10 is particularly suited for use with an eavestrough of the type including a generally flat, vertical rear wall 12, a bottom flange 14 protruding horizontally forward from a bottom edge of the rear wall, and a front wall 16 which is sloped upwardly and forwardly from the forward edge of the bottom flange. The top edge of the front wall 16 is typically folded over inwardly to provide a structurally reinforcing channel at the top edge which is typically slightly lower in elevation than a top edge of the opposing rear wall 12.

The outlet cutter 10 includes a main frame which includes two side frame portions 20 at laterally opposing sides of the cutter. Each side frame portion comprises a rigid rectangular plate spanning substantially the full height and full width of the cutter. The two plates forming the side frame portions 20 are mounted in parallel, fixed relation to one another.

Each side frame portion 20 includes a trough opening 22 formed therein which is generally U-shaped to match the corresponding profile of the rear wall, bottom wall, and front wall of the eavestrough to be slidably received therethrough. The trough openings 22 in the two opposing side frame portions 20 are aligned with one another such that the trough may be oriented to be received to extend laterally fully through the main frame of the cutter in a horizontal orientation with the longitudinal direction of the trough being aligned perpendicularly with the two plates forming the side frame portions 20 of the cutter. The trough openings are slightly oversized relative to the dimensions of the trough so as to readily receive the trough therethrough without interference between the frame and the trough.

The main frame further includes two upper support channels 24 which span laterally between the two side frame portions 20 in perpendicular relation to the side plates to support the side plates in fixed and parallel relation relative to one another. The two upper support channels 24 are located in alignment with opposing front and rear top ends of the U-shaped profile of the trough openings 22. Each upper support channel comprises an angle having a top flange 26 which is horizontally oriented for engaging upon the top edge of a corresponding one of the front wall or rear wall of the trough, and a side flange 28 depending downwardly from an outer edge of the top flange such that the trough is arranged to be located at front and back walls thereof between the depending side flanges 28 of the two upper support channels 24 respectively. The upper support channels 24 are thus arranged such that the main frame of the cutter can be suspended on the trough by engagement of the top flanges 26 onto the top ends of the front wall and rear wall of the trough respectively so as to be longitudinally slidable along the length of the trough.

The main frame of the cutter further comprises two lower support channels 30 which are again fixed to span between the two plates of the side frame portions 20 respectively so as to be parallel to one another and perpendicular to the side plates in fixed relation therewith. Each lower support channel 30 comprises an angle of two flanges oriented in an inverted V shape open to the bottom of the cutter. The lower support channels 30 are spaced apart along the bottom edges of the side frame portions of the cutter adjacent opposing front and rear sides of the main frame of the cutter respectively. By locating the lower support channels 30 along the bottom of the frame, the support channels 30 are accordingly spaced below the trough openings respectively so as not to interfere with sliding support of the frame along a trough by engagement of the upper support channels 24 on the top ends of the front and rear walls of the trough respectively.

A female die plate 32 is supported in fixed relation on the main frame. The die plate 32 comprises a flat plate locating a die opening 34 therein which defines the size and generally rectangular shape of the outlet hole cut by the cutter 10. The die plate is supported to span horizontally between the two side frame portions 20 at the bottom of the trough opening such that the die plate 32 is positioned directly below the bottom flange 14 of a trough which is slidably received through the frame of the cutter. The two side plates forming the side frame portions 20 of the cutter each support a respective support flange 36 thereon in the form of a horizontal flange protruding inwardly from an inner surface of the respective side plate below the bottom portion of the trough opening. Fastener apertures in the two support flanges 36 and at spaced apart positions along each of the opposing sides of the die plate 32 permit threaded fasteners to secure the opposing edges of the die plate to respective ones of the support flanges 36. The threaded fasteners can be readily released to remove the die plate and interchange the female die plate with a different die plate having a different sized die opening 34 therein as may be desired.

A male die 38 is supported between the two side frame portions 20 so as to be vertically movable relative to the female die plate 32 between a disengaged position spaced above the female die plate, and a punching position fully received within the die opening 34 of the female die plate. To support the male die 38, the main frame of the cutter includes a cross frame portion 40 which extends laterally between the two side frame portions 20 in fixed relation thereto at a location which is at an intermediate height relative to the height of the front and rear wall portions of the trough opening and which is at a central location relative to the bottom portion of the trough openings between the front and rear wall portions of the trough opening.

The male die 38 is supported relative to the cross frame portion by a threaded shaft 42 which is vertically oriented at a central location relative to the die opening 34 in the female die plate 32 therebelow. The threaded shaft is threadably received within a corresponding threaded bore 44 located centrally within the cross frame portion 40 such that rotation of the shaft 42 about the upright longitudinal axis thereof causes the shaft to be displaced up and down along the axis relative to the cross frame portion 40 of the main frame.

The male die 38 comprises a die plate rotatably supported at the bottom end of the threaded shaft 42. More particularly, a reduced diameter portion 39 at the bottom end of the threaded shaft 42 is received rotatably through a corresponding sized bore at a central location within the male die plate 38. The groove is provided at the bottom end of the threaded shaft which protrudes from the bottom face of the male die to receive a split retainer ring 41 therein which retains the male die plate rotatably on the bottom end of the threaded shaft. Releasing the split retainer ring 41 permits the male die plate to be removed from the threaded shaft and replaced with a different sized male die plate so that the male and female die plates can always be replaced as a corresponding matching pair with the male die plate matching the size of the opening in the female die plate.

The male die plate is similarly shaped to the die opening 34 so as to be generally rectangular in shape with four corner portions 46 which are rounded in profile. The bottom face of the male die plate defines the cutting face of the die. The bottom cutting face includes a flat central area 48 from which four corner portions 46 of the male die protrude outwardly at a downward slope towards the outermost corners of the opening to be cut. The four corner portions 46 collectively define the perimeter cutting edges of the die which interact in a shearing action with the corresponding edges of the die opening 34 of the female die plate.

Each corner portion 46 of the male die plate is generally triangular in shape so as to be comprised of two cutting side edges which are sloped downwardly and outwardly to a respective apex 52 at the corner which is the lowest point of the corner portion respectively.

Two of the corner portions 46, which are diagonally opposed from one another, are primary cutting tips 54 in which the side edges 50 sloped downwardly at a 25° angle relative to a horizontal plane of the main portion of the male die plate so that the corresponding apexes 52 of the two primary cutting tips form the lowest points of the male die plate which are diametrically opposed and which engage the material to be cut first.

The other two corner portions 46 define secondary cutting tips 56 in which the side edges 50 are sloped downwardly at a 20° angle relative to the horizontal plane of the main portion of the male die plate so that the corresponding apexes 52 of the two secondary tips are at the same elevation relative to one another which corresponds to an elevation at an intermediate location along the sloped side edges 50 of the two primary cutting tips.

The male die plate is further supported by two support posts 60 which are laterally spaced apart at diametrically opposed sides of the threaded shaft 42 so as to be fixed to protrude vertically upward from the top side of the male die plate 38 in parallel relation with the threaded shaft 42. Corresponding bores 62 in the cross frame portion of the main frame, at diametrically opposing sides of the threaded bore receiving the shaft 42 therein, slidably received the support posts 60 therethrough as the male die plate is displaced up and down by the rotation of the threaded shaft relative to the main frame.

The outlet cutter 10 is particularly suited for use with a trough bender 100 of the type used for forming eavestroughs from flat sheet metal material. The flat sheet metal material is typically available in a roll on a drum or reel so that the flat sheet can be unrolled and fed into the inlet side of the trough bender 100. The trough bender includes a plurality of roll-forming rollers supported within the housing of the bender that form the flat sheet metal received at the inlet side of the housing into the eavestrough shape described above having a flat rear wall 12 a bottom flange 14 and a front sloped wall 16. The trough bender is capable of continuously forming the eavestrough shape as flat sheet metal is inserted into the inlet side of the trough bender and the formed eavestrough exits through an opposing outlet side of the housing.

The outlet cutter is intended to be supported at the outlet end of the housing of the trough bender 100 in alignment with the exit location of the formed eavestrough. When the outlet cutter is not in use, it can remain supported on the outlet end of the housing and not interfere with the eavestrough being formed which merely passes fully through the frame of the outlet cutter by being received in the trough openings 22.

In order to support the outlet cutter at the outlet end of the trough bender 100 so that the formed eavestrough can pass through the cutter frame without contacting the cutter, a suitable storage mount 102 is provided. The storage mount includes a mounting plate 104 which supports two rails 106 protruding perpendicularly outward therefrom at parallel and spaced apart positions corresponding to the space between the two lower support channels 30 of the cutter. Each support rail comprises a round rod having a length corresponding approximately to the width of the cutter frame in the lateral direction between the two side frame portions 20. The free ends 107 of the support rails 106 are tapered for ease of sliding the cutter frame onto the support rails 106 when sliding the cutter frame along an eavestrough exiting a trough bender. The mounting plate 104 includes fastener holes therein to permit threaded fasteners to secure the mounting plate to the outlet end of the trough bender. The mounting location of the storage mount is selected such that when the support rails 106 are received within the two lower support channels 30 engaged thereon, the cutter frame is entirely supported on the support rails and the trough openings in the side frame portions of the cutter are aligned with the exit location of the eavestrough exiting the trough bender to enable the exiting eavestrough to pass fully through the trough openings in the cutter without contacting the cutter.

When it is desired to cut an outlet opening in the eavestrough, the user merely slides the cutter 10 off of the support rails 106 and continues to slide the cutter in the longitudinal direction along the trough while the upper support channels 24 are supported on the top edges of the front and rear walls respectively. The cutter is then aligned in the longitudinal direction of the trough with the desired location of an outlet to be cut.

The top end of the threaded shaft 42 which protrudes above the cross frame portion 40 is formed to include a socket 64 therein which has a hexagonal cross-section sized to mate with the conventional hexagonal cross-section of the mounting end of various screw driver bits 65 adapted for being received in common commercially available electric power drills used in the construction industry. The socket 64 has a depth in the axial direction which is greater than the length of the bit portion 67 of the screw driver bit so that the hexagonal mounting end 69 of the screw driver bit can mate with the hexagonal cross section of the socket 64 of the cutter 10 when the bit portion is fully inserted into the socket 64. Operating the drill in forward and reverse directions will rotate the threaded shaft 42 in corresponding forward and reverse directions for displacing the male die 38 towards and away from the female die 32 respectively.

When performing a punching operation, the two primary cutting tips 54 are the first point of engagement of the male die with the bottom flange of the trough to begin cutting at two diagonally opposed locations. Once the two primary cutting tips are partially penetrated through the bottom flange of the trough, the two secondary cutting tips 56 then engage the bottom flange of the trough at respective apexes of the secondary cutting tips. Before punching, the female die is spaced below the upper channels 24 so as to be spaced slightly below the bottom flange of the trough to provide a clearance gap which allows the trough to be freely slid through the trough openings when the device 10 is stored on the rails 106 on a trough bender. Once the primary cutting tips engage the top side of the bottom of the trough after initial rotation to begin a punching operation, continued rotation of the shaft 42 acts to lift the frame with the female die supported thereon relative to the trough until the female die is in firm engagement with the bottom side of the trough. Continued actuation of the drill will complete the punching action by fully penetrating all four corner portions and the full perimeter cutting edge of the male die fully through the bottom flange of the eavestrough and into the female die opening. The last four portions of the outlet opening to be cut include an intermediate segment at a central location along each of the four sides of the generally rectangular shape of the outlet opening. Reversing operation of the drill will return the male die to the disengaged position such that the outlet cutter can be slid along the trough back to a storage position engaged upon the rails of the storage mount. The trough can continue to be continuously formed by the bender such that the formed trough continues to exit the bender by being received in a non-contacting manner through the trough openings of the cut.

When the cutting of the bottom flange is complete, and the male die is fully received within the die opening of the female die, the frame of the cutter device and the female die supported thereon drop back down until the channels 24 engage the top edges of the trough, indicating that the hole has been cut. The operator can then reverse the drill to return the male die to a starting position spaced above the female die. The shape of male die 38, not only cuts a blank piece (or plug) out of the bottom flange of the trough, but also bends the edges of the plug inward, making it smaller in dimension than the rectangular hole in the female die 32 such that the plug doesn't get stuck in die 32 and simply falls out the bottom of the cutting device. No additional spring mechanism is required to eject the plug as in prior art designs of trough outlet cutters.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An outlet cutter for cutting an outlet opening in an eavestrough having a bottom flange, a rear wall extending upwardly from a rear edge of the bottom flange and a front wall extending upwardly from a front edge of the bottom flange, the outlet cutter comprising:

a frame including a trough opening therein arranged to receive the eavestrough therethrough;

a female die including a die opening therein supported on the frame directly below the trough opening so as to be arranged to be located directly below an eavestrough received through the trough opening; and a male die supported on the frame so as to be movable relative to the female die between a disengaged position spaced above the female die and a punching position fully received within the die opening in the female die;

the frame including a sliding support arranged to be engaged upon the eavestrough so as to support the frame slidably along the eavestrough with the female die directly below the bottom flange and the male die spaced above the bottom flange.

2. The outlet cutter according to claim 1 wherein the sliding support of the frame comprises two sliding support channels supported on the frame parallel and spaced apart from one another so as to be arranged to be engaged upon respective top edges of the front wall and rear wall of the eavestrough when the female die is directly below the bottom flange of the eavestrough.

3. The outlet cutter according to claim 1 wherein the frame comprises two side frame portions each locating a respective trough opening therein, the female die being supported between the two side frame portions so as to be located directly below the bottom flange of an eavestrough received through both trough openings of the two side frame portions respectively.

4. The outlet cutter according to claim 1 in combination with a trough bender arranged to roll form an eavestrough and a trough exit from which the formed eavestrough is dispensed, the outlet cutter further comprising a storage mount arranged to selectively support the frame of the outlet cutter thereon, the storage mount being supported on the trough bender such that the trough opening in the frame is aligned with the trough exit so that the formed eavestrough dispensed from the trough bender passes through the trough opening when the outlet cutter is supported on the storage mount.

5. The outlet cutter according to claim 4 wherein the storage mount comprises two rails and wherein the outlet cutter includes two lower support channels receiving the two rails therein when the outlet cutter is supported on the storage mount, the two lower support channels supporting the outlet cutter for longitudinal sliding along the two rails in a longitudinal direction of the eavestrough.

6. The outlet cutter according to claim 5 wherein each of the two rails includes a free end which is tapered for ease of sliding the outlet cutter onto and off of the rails in the longitudinal direction of the eavestrough.

7. The outlet cutter according to claim 1 further comprising a threaded shaft coupling the male die to the frame such that rotation of the threaded shaft drives the male die between the disengaged position and the punching position.

8. The outlet cutter according to claim 7 wherein the threaded shaft includes a quick connection supported thereon for sliding connection to a screw driver bit of a power drill.

9. The outlet cutter according to claim 8 wherein the quick connection comprises a socket having a hexagonal cross section.

10. The outlet cutter according to claim 1 wherein the frame comprises a cross frame portion supporting the male die for sliding movement thereon along a vertical axis relative to the female die and a pair of side frame portions connected between the cross frame portion and the female die at two diametrically opposing sides of the vertical axis.

11. The outlet cutter according to claim 10 wherein the male die is supported for vertical sliding on the cross frame portion at two diametrically opposing sides of the vertical axis.

12. The outlet cutter according to claim 11 further comprising i) a threaded shaft coupling the male die to the cross frame portion at said vertical axis such that rotation of the threaded shaft drives the male die between the disengaged position and the punching position, and ii) a pair of sliding supports providing sliding support between the male die and the cross frame portion at said diametrically opposing sides of the vertical axis.

13. The outlet cutter according to claim 1 wherein the frame supports the female die and the male die thereon such that the female die and the male die are replaceable.

14. The outlet cutter according to claim 1 wherein the male die is rectangular in shape so as to comprise four corner portions, each comprised of a pair of side cutting edges which are sloped downwardly and outwardly towards a respective apex at a respective corner of the rectangular shape of the male die.

15. The outlet cutter according to claim 1 wherein the male die is rectangular in shape so as to comprise four corner portions at respective corners of the rectangular shape of the male die, two diagonally opposed ones of the corner portions comprising two side cutting edges which are sloped downwardly and outwardly towards respective apexes which define primary cutting tips which protrude towards the female die beyond a remainder of the male die.

* * * * *